US006615915B2

(12) United States Patent
Koleilat

(10) Patent No.: US 6,615,915 B2
(45) Date of Patent: Sep. 9, 2003

(54) HIGH PRESSURE SIDE-BY-SIDE WELLHEAD SYSTEM

(75) Inventor: Bashir M. Koleilat, Houston, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/187,914

(22) Filed: Jul. 2, 2002

(65) Prior Publication Data

US 2003/0006035 A1 Jan. 9, 2003

Related U.S. Application Data

(60) Provisional application No. 60/302,869, filed on Jul. 3, 2001.

(51) Int. Cl.[7] ..... E21B 33/03

(52) U.S. Cl. ..... 166/89.2; 166/313; 166/382; 166/359; 166/345; 166/368; 166/242.3; 166/75.13; 175/78; 175/79; 175/9

(58) Field of Search ..... 166/89.2, 75.13, 166/97.5, 242.3, 313, 382, 381, 359, 341, 345, 368

(56) References Cited

U.S. PATENT DOCUMENTS 5,259,459 A 11/1993 Valka
5,330,007 A * 7/1994 Collins et al.
5,458,199 A * 10/1995 Collins et al.
5,560,435 A 10/1996 Sharp
5,655,602 A * 8/1997 Collins
5,971,076 A 10/1999 Taylor et al.

FOREIGN PATENT DOCUMENTS

WO WO99/13198 A1 3/1999

* cited by examiner

*Primary Examiner*—Roger Schoeppel
(74) *Attorney, Agent, or Firm*—Henry C. Query, Jr.

(57) ABSTRACT

The present invention is a wellhead system for use in completing at least two well bores from within a single conductor housing. The wellhead system comprises at least one wellhead housing which is supported on the conductor housing and which comprises a top portion that is adapted to be connected to a lower portion of a wellhead component, a casing hanger which is supported within the wellhead housing and from which a casing string is suspended, and a connector for securing the wellhead component to the wellhead housing. In accordance with the present invention, the connector is selected from the group consisting of a latch ring and a segmented clamp assembly.

26 Claims, 5 Drawing Sheets

HIGH PRESSURE SIDE-BY-SIDE WELLHEAD SYSTEM

This application is based on U.S. Provisional Patent Application No. 60/302,869, which was filed on Jul. 3, 2001.

BACKGROUND OF THE INVENTION

The present invention relates to a side-by-side wellhead system which may be used to drill and complete a number of hydrocarbon wells. More particularly, the present invention relates to a side-by-side wellhead system which comprises one or more high strength, low profile connectors to secure the wellhead housing component of the system to certain other components, such as a drilling riser or a christmas tree.

Prior art side-by-side (SXS) wellhead systems are commonly used to drill and complete a number of hydrocarbon wells from within a single conductor housing. As shown in FIG. 5, such a wellhead system may comprise a base plate 74 which is welded to the top of a conductor housing 70, two casing strings 76*a* and 76*b* which are each suspended from the base plate, and a landing support ring 72 which is bolted to the top of the base plate. In this example, the well on the right hand side of FIG. 5 is covered by an abandonment cap 78, which is connected to the top of the landing support ring 72 with a bolted flange connection that comprises a number of bolts 80. In addition, a wellhead housing 60 is installed in the well on the left hand side of FIG. 5 and is connected to the landing support ring 72 using a bolted flange connection which includes a number of bolts 66, only one of which is shown. Furthermore, in the drilling mode of operation of the SXS wellhead system shown in FIG. 5, a drilling riser 62 is connected to the top of the wellhead housing 60 via a bolted flange connection which comprises plurality of bolts 64, only one of which is shown.

The bolted flange connections which are used to connect the various components of prior art SXS wellhead systems are time consuming to install and remove. In addition, the offset loading inherent in SXS wellhead systems limits the maximum operating pressures such bolted flange connections can safely withstand. Furthermore, the flanges themselves occupy a substantial portion of the available cross-sectional area of the wellhead housing, thus reducing the maximum diameter of well casing which can be used in the SXS wellhead system.

SUMMARY OF THE INVENTION

These and other limitations in the prior art are addressed by providing a wellhead system for use in completing at least two well bores from within a single conductor housing. The wellhead system comprises at least one wellhead housing which is supported on the conductor housing and which comprises a top portion that is adapted to be connected to a lower portion of a wellhead component, a casing hanger which is supported within the wellhead housing and from which a casing string is suspended, and a connector for securing the wellhead component to the wellhead housing. In accordance with the present invention, the connector is selected from the group consisting of a latch ring and a segmented clamp assembly.

In one embodiment of the invention, the wellhead component comprises a christmas tree which includes a lower connection portion that is received within the top portion of the wellhead housing and the connector comprises a radially expandable latch ring which is disposed between the lower connection portion and the wellhead housing. In addition, the latch ring is supported on the lower connection portion and is expandable into a groove which is formed on the wellhead housing to thereby secure the christmas tree to the wellhead housing.

In another embodiment of the invention, the wellhead component comprises a drilling riser and the connector comprises a segmented clamp assembly which is secured around the wellhead housing and the drilling riser. In addition, the segmented clamp assembly extends around the wellhead housing and the drilling riser an angle of less than 360°. Furthermore, where the wellhead system comprises three wellhead housings, the segmented clamp assembly extends around the wellhead housing and the drilling riser an angle of approximately 225°. Moreover, the segmented clamp assembly is preferably supported on the drilling riser prior to being engaged with the wellhead housing.

Thus, the SXS wellhead system of the present invention uses a segmented clamp assembly during the drilling mode of operation, and an internally latching connector during the completion and/or temporary abandonment mode of operation. These types of connectors offer several advantages over the bolted flange connections used on existing SXS systems. Both the segmented clamp assembly and the internally latching connector allow for greater operating pressures within the system because they are able to withstand greater bending moments than the bolted flange connections used on existing SXS systems. In addition, the reduced profile of the internally latching connector allows for larger casing strings to be suspending in a given wellhead housing. Furthermore, the use of an internally latching connector in the production mode of operation provides a cost effective method for connecting the tree to the wellhead housing, since there is no need to leave a permanent segmented connector on the wellhead housing.

These and other objects and advantages of the present invention will be made apparent from the following detailed description, with reference to the accompanying drawings.

DETAILED DESCRIPTION OF THE PREFERRED EMBODIMENTS

Figure 1:
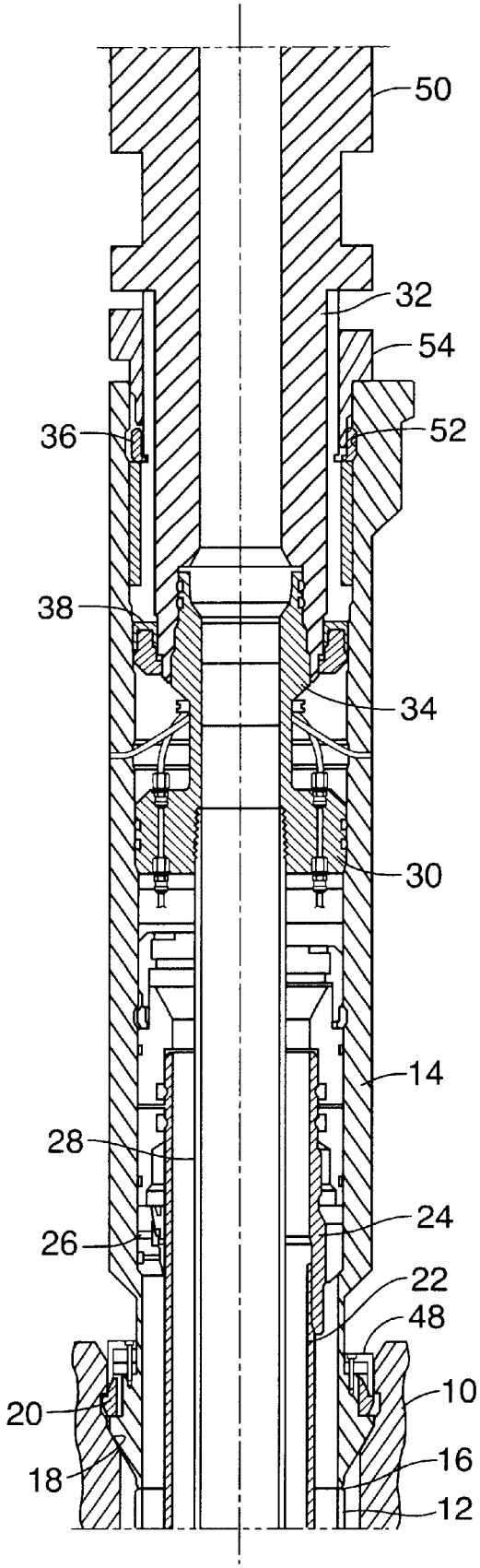
FIG. 1 is a cross-sectional view of a single completion embodiment of the SXS system of the present invention.

Referring to FIG. 1, a single completion embodiment of the SXS wellhead system of the present invention is shown in its completion mode of operation. The SXS wellhead system comprises at least one wellhead housing 14 which is supported on a template 10 that is secured such as by welding to a conductor housing (not shown). For example, two or three 13 ⅝-inch wellhead housings 14 could be installed in a single 36-inch conductor housing. Each wellhead housing 14 is landed on a preferably 45° load shoulder 18 which is formed in the template 10. In addition, each wellhead housing 14 is locked to the template with an expanding lock ring 20, which may be contracted from its locked position, which is shown on the left hand side of FIG.

1, into its unlocked position, which is shown on the right hand side of FIG. 1, via a mandrel ring 48 that is threadedly secured to the wellhead housing. The SXS wellhead system also comprises a number of casing strings 12, such as 13 ⅜-inch casing strings, each of which is ideally butt welded at 16 to the bottom of a corresponding wellhead housing 14.

Referring still to FIG. 1, the SXS wellhead system of the present invention may be used to support an intermediate casing string 22 within the casing string 12. The intermediate casing string 22 may be suspended from a conventional casing hanger 24, which is shown on the right hand side of FIG. 1, or alternatively from a slip type casing hanger 26, which is shown on the left hand side of FIG. 1. In either case, the casing hanger 24, 26 is in turn supported in a conventional manner on a load shoulder which is formed in the bore of the wellhead housing 14.

The SXS wellhead system may also be used to support a tubing string 28 within the intermediate casing string 22. The tubing string 28 is connected to a tubing hanger 30, which in turn is supported and sealed in a conventional manner within the bore of the wellhead housing 14.

In accordance with the present invention, a bottom connection 32 of a single-bore christmas tree 50 is installed over an upwardly extending neck 34 of the tubing hanger 30 within the top portion of the wellhead housing 14. A conventional SBMS seal 38, or any other metal-to-metal or non-metallic seal, is preferably positioned between the outer diameter of the bottom connection 32 and the inner diameter of the wellhead housing 14 to seal between the tree 50 and the wellhead housing. In addition, the bottom connection 32 is secured to the wellhead housing 14 via an internal latch ring 36, which engages a corresponding groove 52 that is formed on the inner diameter of the wellhead housing. The latch ring 36 may be moved from its retracted or unlocked position, which is shown on the left hand side of FIG. 1, into its locked position, which is shown on the right hand side of FIG. 1, using a conventional locking mandrel 54 that is movably supported on the bottom connection 32 in the usual manner.

Figure 2:
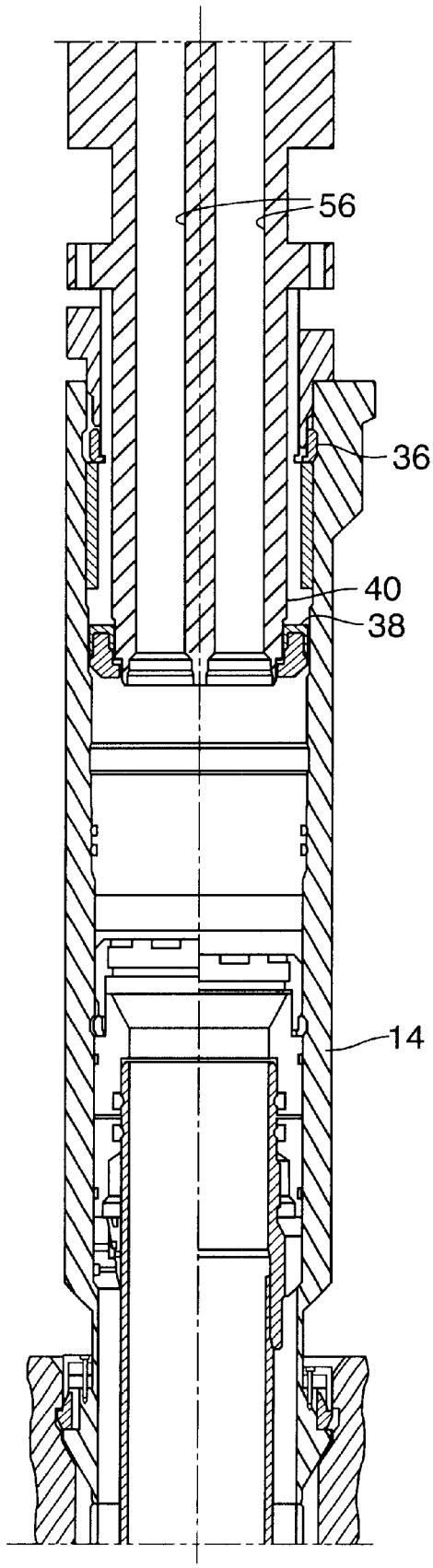
FIG. 2 is a cross-sectional view of a dual completion embodiment of the SXS system of the present invention.

Referring now to FIG. 2, a dual completion embodiment of the SXS wellhead system of the present invention is shown in its completion mode of operation. In this embodiment of the invention, a dual completion christmas tree 40 is landed within the top of the wellhead housing 14. The tree 40 is preferably sealed and locked to the wellhead housing 14 using a seal 38 and a latch ring 36, such as were described above. The tree comprises a number of fluid flow bores 56 which, due to the relatively small radial profile of the latch ring 36, may be positioned at the maximum center-to-center distance recommended by the American Petroleum Institute.

Figure 3:
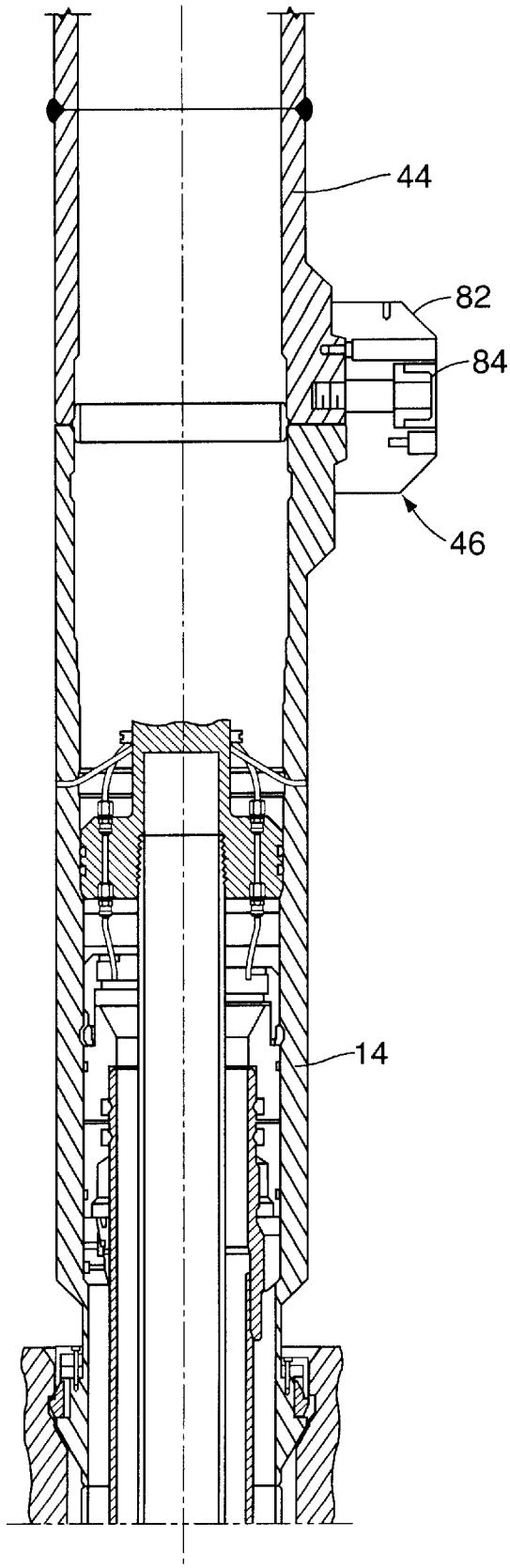
FIG. 3 is a cross-sectional view of the upper portion of the system of FIG. 1 shown in the drilling mode of operation.
Figure 4:
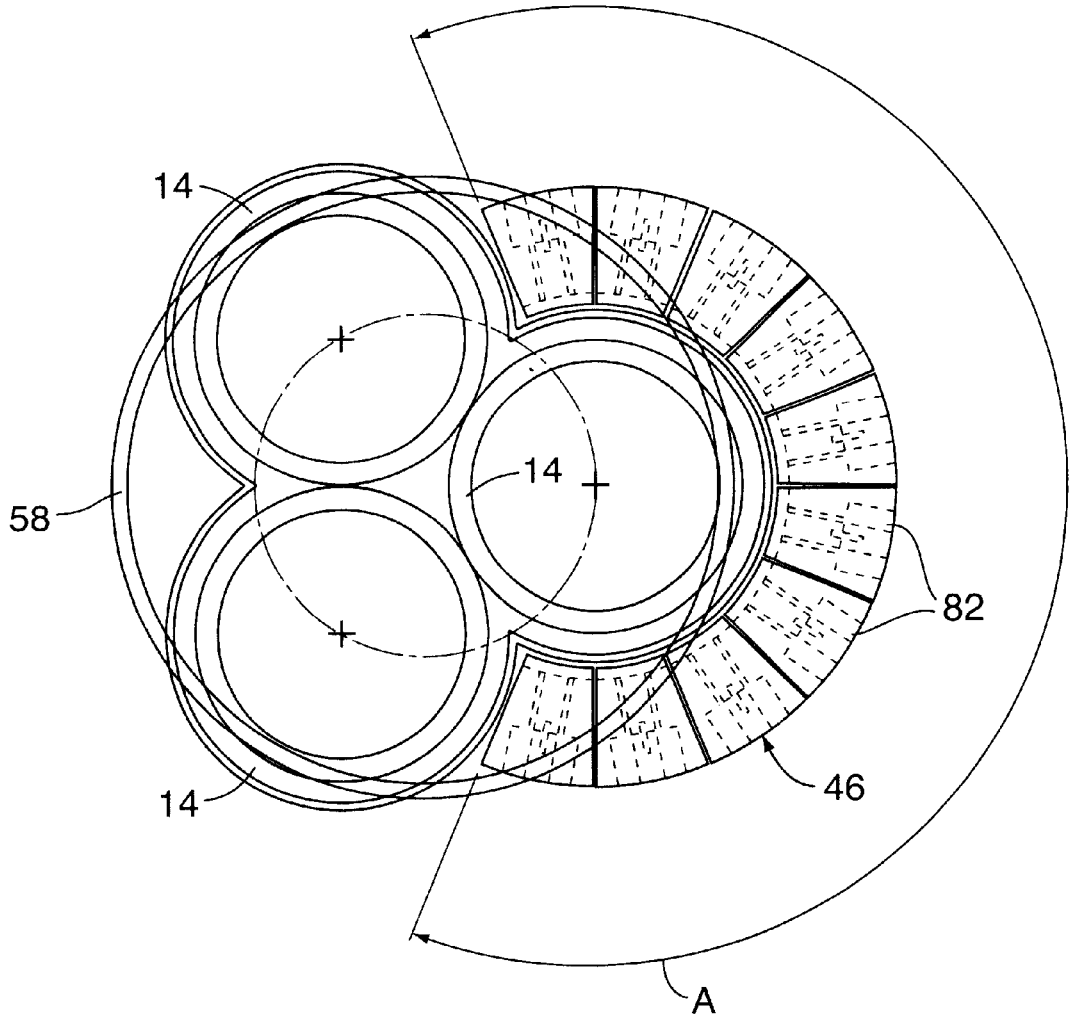
FIG. 4 is a top plan view of the SXS system shown in FIG. 3.
Figure 5:
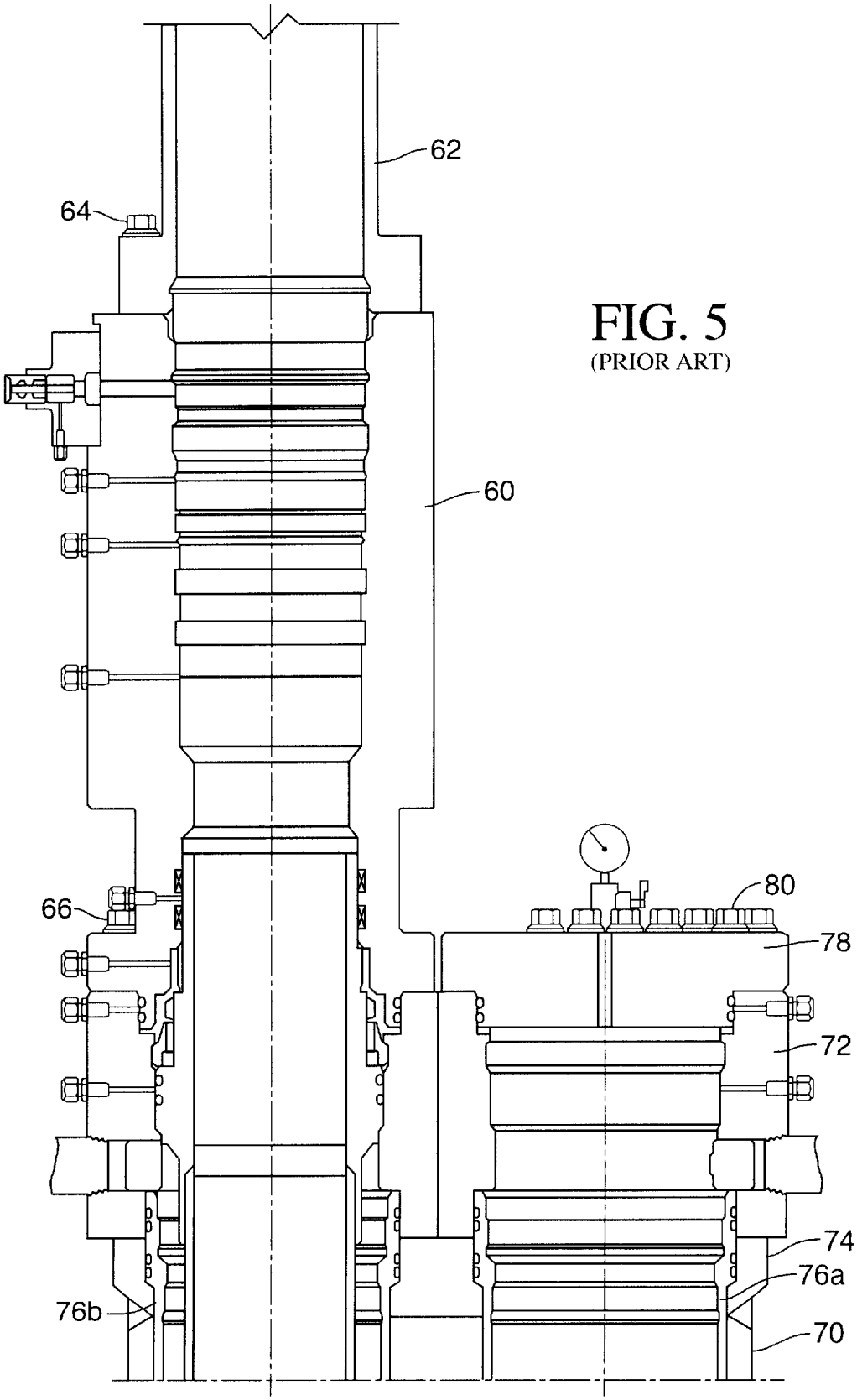
FIG. 5 (PRIOR ART)
FIG. 5 is a cross-sectional view of a prior art SXS system shown in the drilling mode of operation.

Referring to FIGS. 3 and 4, the embodiment of the SXS wellhead system of FIG. 1 is shown in its drilling mode of operation. In this mode of operation, a drilling riser 44 is connected to the top of the wellhead housing 14 via a segmented clamp assembly 46. Similar to a conventional segmented clamp assembly, the segmented clamp assembly 46 comprises a plurality of individual clamp segments 82 which are each secured to, for example, the drilling riser 44 with a bolt 84. As best seen in FIG. 4, the segmented clamp assembly 46 extends through an angle A of less than 360° in order to clear the other wellhead housings 14 which are mounted in the conductor housing 58. In the embodiment of the invention shown in FIG. 4, in which three wellhead housings 14 are supported by the conductor housing 58, the segmented clamp assembly 46 preferably extends through an angle A of approximately 225° degrees. In a preferred embodiment of the invention, the segmented clamp assembly 46 is attached to and travels with the riser 44 and is not a permanent component of the wellhead housing 14.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A wellhead system for use in completing at least two well bores from within a single conductor housing which comprises:

at least one wellhead housing which is supported on the conductor housing;

a casing hanger which is supported within the wellhead housing and from which a casing string is suspended;

a christmas tree which includes a lower connection portion that is received within a top portion of the wellhead housing; and means disposed between the lower connection portion and the wellhead housing for securing the christmas tree to the wellhead housing.

2. The wellhead system of claim 1, wherein the securing means comprises a radially expandable latch ring.

3. The wellhead system of claim 2, wherein the latch ring is supported on the lower connection portion.

4. The wellhead system of claim 3, wherein the latch ring is expandable into a groove which is formed on the wellhead housing to thereby secure the christmas tree to the wellhead housing.

5. The wellhead system of claim 4, further comprising means for expanding the latch ring.

6. The wellhead system of claim 5, wherein the expanding means comprises a locking mandrel which is movably supported on the lower connection portion.

7. The wellhead system of claim 1, further comprising means for sealing between the christmas tree and the wellhead housing.

8. The wellhead system of claim 7, wherein the sealing means comprises a seal which is positioned between the lower connection portion and the wellhead housing.

9. The wellhead system of claim 8, wherein the seal comprises an SBMS seal.

10. A wellhead system for use in completing at least two well bores from within a single conductor housing which comprises:

at least one wellhead housing which is supported on the conductor housing;

a casing hanger which is supported within the wellhead housing and from which a casing string is suspended;

a segmented clamp assembly for securing a drilling riser to a top portion of the wellhead housing.

11. The wellhead system of claim 10, wherein the segmented clamp assembly extends around the wellhead housing and the drilling riser an angle of less than 360°.

12. The wellhead system of claim 11, wherein the segmented clamp assembly extends around the wellhead housing and the drilling riser an angle of approximately 225°.

13. The wellhead system of claim 10, wherein the segmented clamp assembly is supported on the drilling riser prior to being engaged with the wellhead housing.

14. A wellhead system for use in completing at least two well bores from within a single conductor housing which comprises:

at least one wellhead housing which is supported on the conductor housing and which comprises a top portion that is adapted to be connected to a lower portion of a wellhead component;

a casing hanger which is supported within the wellhead housing and from which a casing string is suspended; and a connector for securing the wellhead component to the wellhead housing, the connector being selected from the group consisting of a latch ring and a segmented clamp assembly.

15. The wellhead system of claim 14, wherein the wellhead component comprises a christmas tree which includes a lower connection portion that is received within the top portion of the wellhead housing and the connector comprises a radially expandable latch ring which is disposed between the lower connection portion and the wellhead housing.

16. The wellhead system of claim 15, wherein the latch ring is supported on the lower connection portion.

17. The wellhead system of claim 16, wherein the latch ring is expandable into a groove which is formed on the wellhead housing to thereby secure the christmas tree to the wellhead housing.

18. The wellhead system of claim 17, further comprising means for expanding the latch ring.

19. The wellhead system of claim 18, wherein the expanding means comprises a locking mandrel which is movably supported on the lower connection portion.

20. The wellhead system of claim 15, further comprising means for sealing between the christmas tree and the wellhead housing.

21. The wellhead system of claim 20, wherein the sealing means comprises a seal which is positioned between the lower connection portion and the wellhead housing.

22. The wellhead system of claim 21, wherein the seal comprises an SBMS seal.

23. The wellhead system of claim 14, wherein the wellhead component comprises a drilling riser and the connector comprises a segmented clamp assembly which is secured around the wellhead housing and the drilling riser.

24. The wellhead system of claim 23, wherein the segmented clamp assembly extends around the wellhead housing and the drilling riser an angle of less than 360°.

25. The wellhead system of claim 24, wherein the segmented clamp assembly extends around the wellhead housing and the drilling riser an angle of approximately 225°.

26. The wellhead system of claim 23, wherein the segmented clamp assembly is supported on the drilling riser prior to being engaged with the wellhead housing.

* * * * *